US009952537B2

(12) United States Patent
Hiroi

(10) Patent No.: US 9,952,537 B2
(45) Date of Patent: Apr. 24, 2018

(54) IMAGE FORMING APPARATUS, CONTROL METHOD, AND CONTROL PROGRAM

(71) Applicant: Konica Minolta, Inc., Chiyoda-ku, Tokyo (JP)

(72) Inventor: Toshiaki Hiroi, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/370,344

(22) Filed: Dec. 6, 2016

(65) Prior Publication Data

US 2017/0160681 A1 Jun. 8, 2017

(30) Foreign Application Priority Data

Dec. 7, 2015 (JP) ..... 2015-238695

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
None
See application file for complete search history.

(56) References Cited

U.S. PATENT DOCUMENTS 4,979,000 A * 12/1990 Hamada ..... G03G 15/6535 361/235
5,923,933 A * 7/1999 Anzai ..... G03G 15/09 399/269
2007/0258737 A1* 11/2007 Ogiyama ..... G03G 15/1675 399/315
2013/0064559 A1* 3/2013 Nakamura ..... G03G 15/1675 399/44
2015/0185668 A1* 7/2015 Matsuzaki ..... G03G 15/1675 399/66

FOREIGN PATENT DOCUMENTS

| | | | |
|---|---|---|---|
| JP | S61087179 A | | 5/1986 |
| JP | H11038783 A | | 2/1999 |
| JP | 2000242062 A | * | 9/2000 |
| JP | 2001331075 A | | 11/2001 |
| JP | 2013061453 A | | 4/2013 |
| JP | 2013083951 A | | 5/2013 |

OTHER PUBLICATIONS

JP 2000242062 English machine translation, Hatakeyama, dated Sep. 8, 2000.*
JP Notice of Reasons for Rejection corresponding to Application No. 2015-238695; dated Dec. 25, 2017.

* cited by examiner

*Primary Examiner* — Thomas Giampaolo, II
(74) *Attorney, Agent, or Firm* — Cantor Colburn LLP

(57) ABSTRACT

An image forming apparatus that transfers a toner image to a medium being conveyed includes: an image carrier configured to carry the toner image; a transfer member configured to apply, to the medium being conveyed, a first AC voltage which is opposite in polarity to the toner image and on which a DC component and an AC component are superimposed, and transfer the toner image to the medium; a charge removing member configured to apply, to the medium being conveyed, a second AC voltage which is opposite in polarity to the first AC voltage and on which a DC component and an AC component are superimposed after the first AC voltage is applied to the medium; and a control unit configured to change a frequency of the second AC voltage when a distance between the medium being conveyed and the charge removing member becomes shorter than a predetermined distance.

20 Claims, 11 Drawing Sheets

124

| PAPER PROPERTY | VOLTAGE CONTROL VALUE | |
|---|---|---|
| THICKNESS OF PAPER ($g/cm^2$) | TRANSFER MEMBER | CHARGE REMOVING MEMBER |
| $x_1$ TO $x_2$ | A1 | B1 |
| $x_2$ TO $x_3$ | A2 | B2 |
| ⋮ | ⋮ | ⋮ |

IMAGE FORMING APPARATUS, CONTROL METHOD, AND CONTROL PROGRAM

CROSS REFERENCE TO RELATED APPLICATIONS

The entire disclosure of Japanese Patent Application No. 2015-238695 filed on Dec. 7, 2015 including description, claims, drawings, and abstract are incorporated herein by reference in its entirety.

BACKGROUND OF THE INVENTION

Field of the Invention

The present disclosure relates to control of an image forming apparatus, particularly to control of an electrophotographic image forming apparatus.

Description of the Related Art

An electrophotographic image forming apparatus is in widespread use. The electrophotographic image forming apparatus in a printing process executes a step of forming a toner image corresponding to an input image on an image carrier such as a photoreceptor and an intermediate transfer body, a step of transferring the toner image on the image carrier to a sheet of paper, and a step of fixing the toner image to the paper.

An alternating current (AC) transfer technique is known as a technique of transferring the toner image from the image carrier to the paper. In an AC transfer process, an AC voltage which is opposite in polarity to the toner image and on which a DC component and an AC component are superimposed is applied to the toner image by a transfer member. The AC voltage applied in the AC transfer process will also be hereinafter referred to as a "transfer voltage". The application of the transfer voltage causes a reciprocating motion of toners, among which physical and electrical interactions occur. As a result, adhesion of the toners is reduced to result in improved transferability of the toner image from the image carrier to the paper. Unevenness in density of the toner image is prevented as well.

However, the application of the transfer voltage sometimes causes the paper to be electrically charged and attracted to the image carrier. An AC charge removing technique that separates the paper from the image carrier is known as a technique of preventing such situation. In an AC charge removing process, an AC voltage which is opposite in polarity to the transfer voltage and on which a DC component and an AC component are superimposed is applied to the paper by a charge removing member. The electrical charge is removed from the paper as a result. The AC voltage applied in the AC charge removing process will also be hereinafter referred to as a "charge removing voltage".

Regarding a technique in which the AC transfer technique and the AC charge removing technique are combined, JP 61-87179 A discloses a copying machine "capable of performing stable transfer and separation without causing retransferring". JP 11-38783 A discloses an image forming apparatus that "smoothly removes an electrical charge accumulated in an intermediate transfer body". JP 2013-83951 A discloses an image forming apparatus that "prevents a leak between members to which AC is applied".

The copying machine disclosed in JP 61-87179 A detects an image region from an original and applies a lower DC component voltage of the AC voltage to the image region than that applied to a non-image region. However, the electrical charge is not effectively removed from the paper when the DC component voltage is decreased.

The image forming apparatus disclosed in JP 11-38783 A applies the charge removing voltage opposite in phase to the transfer voltage to the intermediate transfer body in the AC charge removing process. The image forming apparatus thus removes the electrical charge from the intermediate transfer body. However, the phase of the transfer voltage and the charge removing voltage is shifted from what is intended in some cases when the paper is not stably conveyed, for example. In this case, the image forming apparatus disclosed in JP 11-38783 A cannot effectively remove the electrical charge from the intermediate transfer body.

A potential difference between the transfer member and the charge removing member is increased when the AC transfer technique is combined with the AC charge removing technique, in which case there is a possibility that an electrical discharge (leak) occurs between the transfer member and the charge removing member. In order to prevent such leak, the image forming apparatus disclosed in JP 2013-83951 A sets the transfer voltage and the charge removing voltage in phase with each other. This allows the potential difference between the transfer member and the charge removing member to be decreased to prevent the leak therebetween. However, when the transfer voltage and the charge removing voltage are set to be in phase with each other, a potential difference between the paper and the charge removing member is fixed so that the electrical charge is not effectively removed from the paper. As a result, unevenness in the potential of the paper is not eliminated to cause a failure to convey the paper and noise accompanying the failure. Moreover, the unevenness in the potential possibly affects the toner image and degrades print quality.

SUMMARY OF THE INVENTION

The present disclosure has been made in order to solve the aforementioned problems where, according to an aspect, an object of the present disclosure is to provide an image forming apparatus capable of removing the electrical charge more effectively than a related art from paper onto which a toner image is transferred. According to another aspect, an object of the present disclosure is to provide a control method by which the electrical charge can be removed more effectively than a related art from the paper onto which the toner image is transferred. According to yet another aspect, an object of the present disclosure is to provide a control program with which the electrical charge can be removed more effectively than a related art from the paper onto which the toner image is transferred.

To achieve at least one of the abovementioned objects, according to an aspect, an image forming apparatus that transfers a toner image formed according to an input image to a medium being conveyed, reflecting one aspect of the present invention comprises: an image carrier configured to carry the toner image; a transfer member configured to apply, to the medium being conveyed, a first AC voltage which is opposite in polarity to the toner image and on which a DC component and an AC component are superimposed, and transfer the toner image to the medium; a charge removing member configured to apply, to the medium being conveyed, a second AC voltage which is opposite in polarity to the first AC voltage and on which a DC component and an AC component are superimposed after the first AC voltage is applied to the medium; and a control unit configured to change a frequency of the second AC voltage when a distance between the medium being conveyed and the charge removing member becomes shorter than a predetermined distance.

The transfer member and the charge removing member are preferably provided along a path through which the medium is conveyed. The predetermined distance is preferably shorter than a distance between the charge removing member and the transfer member.

The image carrier and the charge removing member are preferably provided while interposing the path through which the medium is conveyed between the image carrier and the charge removing member.

The predetermined distance is preferably shorter than a distance between the charge removing member and the image carrier.

The image forming apparatus preferably further comprises a detection unit configured to detect the medium upstream of the charge removing member on the path through which the medium is conveyed. A timing at which the control unit changes the frequency of the second AC voltage preferably includes a timing corresponding to a lapse of predetermined time after the medium is detected by the detection unit.

The image forming apparatus preferably further comprises a detection unit configured to detect the medium passing through an area of contact between the image carrier and the transfer member. The image carrier and the transfer member are preferably in contact with each other while interposing the path through which the medium is conveyed between the image carrier and the transfer member. The timing at which the control unit changes the frequency of the second AC voltage preferably includes a timing corresponding to a lapse of predetermined time after the medium is detected by the detection unit.

The frequency of the second AC voltage is preferably higher than a frequency of the first AC voltage.

The frequency of the second AC voltage is preferably an integral multiple of a frequency of the first AC voltage.

The medium is preferably paper. The control unit preferably acquires a control value corresponding to a property of the paper being conveyed on the basis of paper information specifying a control value of the first AC voltage for each paper property, and controls the first AC voltage according to the control value.

The medium is preferably paper. The control unit preferably acquires a control value corresponding to a property of the paper being conveyed on the basis of paper information specifying a control value of the second AC voltage for each paper property, and controls the second AC voltage according to the control value.

The image forming apparatus preferably further comprises an insulating member that is provided between the transfer member and the charge removing member.

To achieve at least one of the abovementioned objects, according to an aspect, a method of controlling an image forming apparatus, reflecting one aspect of the present invention comprises the steps of: forming a toner image corresponding to an input image; conveying a medium; applying, to the medium being conveyed, a first AC voltage which is opposite in polarity to the toner image and on which a DC component and an AC component are superimposed, and transferring the toner image to the medium; employing a charge removing member provided on a path through which the medium is conveyed to apply, to the medium, a second AC voltage which is opposite in polarity to the first AC voltage and on which a DC component and an AC component are superimposed after applying the first AC voltage to the medium; and changing a frequency of the second AC voltage when a distance between the medium being conveyed and the charge removing member becomes shorter than a predetermined distance.

To achieve at least one of the abovementioned objects, according to an aspect, there is provided a non-transitory recording medium storing a computer readable program for controlling an image forming apparatus, and the program reflecting one aspect of the present invention causes the image forming apparatus to execute the steps of: forming a toner image corresponding to an input image; conveying a medium; applying, to the medium being conveyed, a first AC voltage which is opposite in polarity to the toner image and on which a DC component and an AC component are superimposed, and transferring the toner image to the medium; employing a charge removing member provided on a path through which the medium is conveyed to apply, to the medium, a second AC voltage which is opposite in polarity to the first AC voltage and on which a DC component and an AC component are superimposed after applying the first AC voltage to the medium; and changing a frequency of the second AC voltage when a distance between the medium being conveyed and the charge removing member becomes shorter than a predetermined distance.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
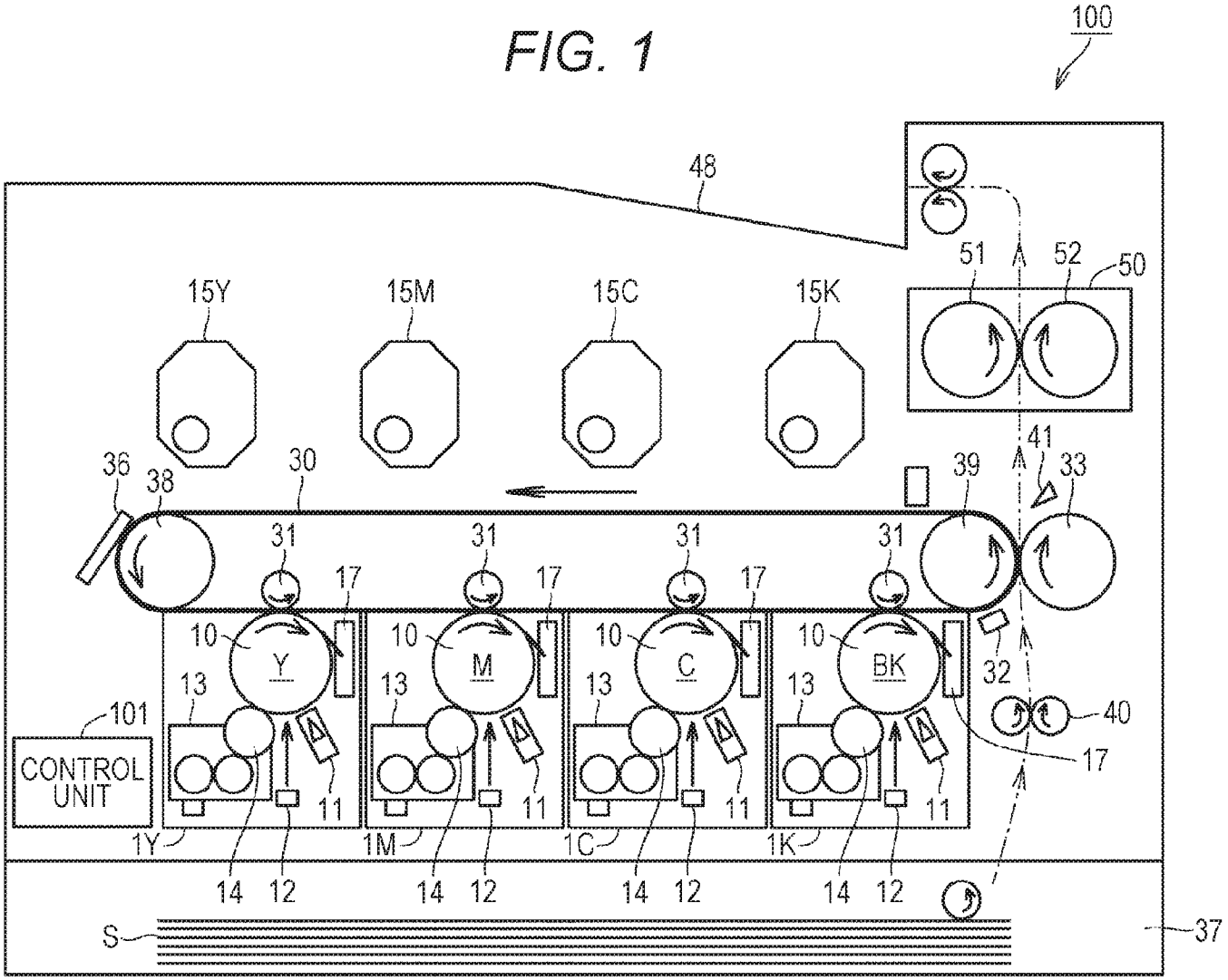
FIG. 1 is a diagram illustrating an example of the configuration of an image forming apparatus according to a first embodiment.

Hereinafter, an embodiment of the present invention will be described with reference to the drawings. However, the scope of the invention is not limited to the illustrated examples. Identical parts and components are assigned identical reference numerals in the following description. Names and functions of those identical parts and components are also identical. Accordingly, detailed description of those parts and components will not be repeated. Note that embodiments and variations described hereinafter may be selectively combined as appropriate.

First Embodiment

[Internal Structure of Image Forming Apparatus 100]

An image forming apparatus 100 according to an embodiment will be described with reference to FIG. 1. FIG. 1 is a diagram illustrating an example of the configuration of the image forming apparatus 100.

FIG. 1 illustrates the image forming apparatus 100 as a color printer. While the image forming apparatus 100 as the color printer will be described below, the image forming apparatus 100 is not limited to the color printer. The image forming apparatus 100 may be a monochrome printer, a facsimile machine, or a multi-functional peripheral (MFP) including the monochrome printer, color printer and facsimile machine, for example.

The image forming apparatus 100 includes image forming units 1Y, 1M, 1C, and 1K, an intermediate transfer belt 30 (image carrier), a primary transfer member 31, an optical sensor 32, a secondary transfer member 33, a cassette 37, a driven roller 38, a driving roller 39, a timing roller 40, a charge removing member 41, a fixing unit 50, a cleaning blade 36, and a control unit 101.

The image forming unit 1Y forms a yellow (Y) toner image with toner supplied from a toner bottle 15Y. The image forming unit 1M forms a magenta (M) toner image with toner supplied from a toner bottle 15M. The image forming unit 1C forms a cyan (C) toner image with toner supplied from a toner bottle 15C. The image forming unit 1K forms a black (BK) toner image with toner supplied from a toner bottle 15K.

The image forming units 1Y, 1M, 1C, and 1K are arranged in order along the intermediate transfer belt 30 in the direction of rotation thereof. Each of the image forming units 1Y, 1M, 1C, and 1K includes a photoreceptor 10 (image carrier), a charging unit 11, an exposure unit 12, a developing unit 13, and a cleaning blade 17.

The charging unit 11 charges the surface of the photoreceptor 10 evenly. The exposure unit 12 irradiates the photoreceptor 10 with a laser beam in response to a control signal from the control unit 101 and exposes the surface of the photoreceptor 10 according to a specified image pattern. As a result, an electrostatic latent image corresponding to an input image is formed on the photoreceptor 10.

The developing unit 13 applies a developing bias to a developing roller 14 while rotating the developing roller 14 and causes the toner to adhere to the surface of the developing roller 14. As a result, the toner is transferred from the developing roller 14 to the photoreceptor 10, on the surface of which the toner image corresponding to the electrostatic latent image is developed.

The photoreceptor 10 and the intermediate transfer belt 30 are in contact with each other in an area where the primary transfer member 31 is provided. A transfer bias applied to the area of contact causes the toner image developed on the photoreceptor 10 to be transferred to the intermediate transfer belt 30. At this time, the yellow (Y) toner image, the magenta (M) toner image, the cyan (C) toner image and the black (BK) toner image are overlaid successively to be transferred to the intermediate transfer belt 30. A color toner image is thus formed on the intermediate transfer belt 30.

The intermediate transfer belt 30 is stretched between the driven roller 38 and the driving roller 39. The driving roller 39 is connected to a motor (not shown). The motor is controlled by the control unit 101, for example. Pulse width modulation (PWM) control is adopted as a method of controlling the motor, for example. The motor is controlled by the control unit 101 to allow the intermediate transfer belt 30 and the driven roller 38 to rotate in conjunction with the driving roller 39. The toner image on the intermediate transfer belt 30 is thus conveyed to the secondary transfer member 33.

The cleaning blade 17 is pressed against the photoreceptor 10. The cleaning blade 17 collects the toner remaining on the surface of the photoreceptor 10 after the toner image is transferred from the photoreceptor 10 to the intermediate transfer belt 30.

The optical sensor 32 images the toner image on the intermediate transfer belt 30 to generate an image of the toner image. The image is then output to the control unit 101. The control unit 101 calculates density of the toner image from the image and adjusts the level of exposure and the like of the photoreceptor 10 such that the density of the toner image equals a target value.

Paper S (a medium) is set in the cassette 37. The paper S is sent one sheet at a time from the cassette 37 to the secondary transfer member 33 by the timing roller 40. The control unit 101 controls a transfer voltage applied to the paper S by the secondary transfer member 33 and a charge removing voltage applied to the paper S by the charge removing member 41 at a timing the paper S is sent by the timing roller 40.

The secondary transfer member 33 applies, to the paper S being conveyed, the transfer voltage (a first AC voltage) which is opposite in polarity to the toner image and on which a DC component and an AC component are superimposed. The toner image is transferred to an appropriate position on the paper S by synchronizing the timing for sending and conveying the paper S and the position of the toner image on the intermediate transfer belt 30.

The charge removing member 41 applies, to the paper S being conveyed, the charge removing voltage (a second AC voltage) which is opposite in polarity to the transfer voltage and on which a DC component and an AC component are superimposed. As a result, unevenness in the potential of the paper S caused by the application of the transfer voltage can be eliminated. The charge removing member 41 is a blade electrode, for example. The thickness of the charge removing member 41 equals 0.05 mm, for example. The needle pitch of the charge removing member 41 equals 3 mm, for example.

The fixing unit 50 includes a heat roller 51 and a pressure roller 52. The fixing unit 50 causes the paper S to pass between the heat roller 51 and the pressure roller 52 to apply pressure and heat to the paper S. The toner image transferred to the paper S is thus fixed to the paper S. After that, the paper S is ejected to a tray 48.

Note that in FIG. 1, a path through which the paper S is conveyed from the cassette 37 to the tray 48 is indicated with a dot and dash line.

The cleaning blade 36 is pressed against the intermediate transfer belt 30. The cleaning blade 36 collects the toner remaining on the surface of the intermediate transfer belt 30 after the toner image is transferred from the intermediate transfer belt 30 to the paper S. The collected toner is conveyed by a conveying screw (not shown) and stored in a waste toner container (not shown).

[Controlling Transfer Voltage and Charge Removing Voltage]

As described above, the secondary transfer member 33 applies, to the paper S being conveyed, the transfer voltage (the first AC voltage) which is opposite in polarity to the toner image and on which the DC component and the AC component are superimposed, whereby the toner image on the intermediate transfer belt 30 is transferred to the paper S. The charge removing member 41 applies, to the paper S, the charge removing voltage which is opposite in polarity to the transfer voltage and on which the DC component and the AC component are superimposed, thereby eliminating the unevenness in the potential of the paper S caused by the application of the transfer voltage (the second AC voltage).

Figure 2:
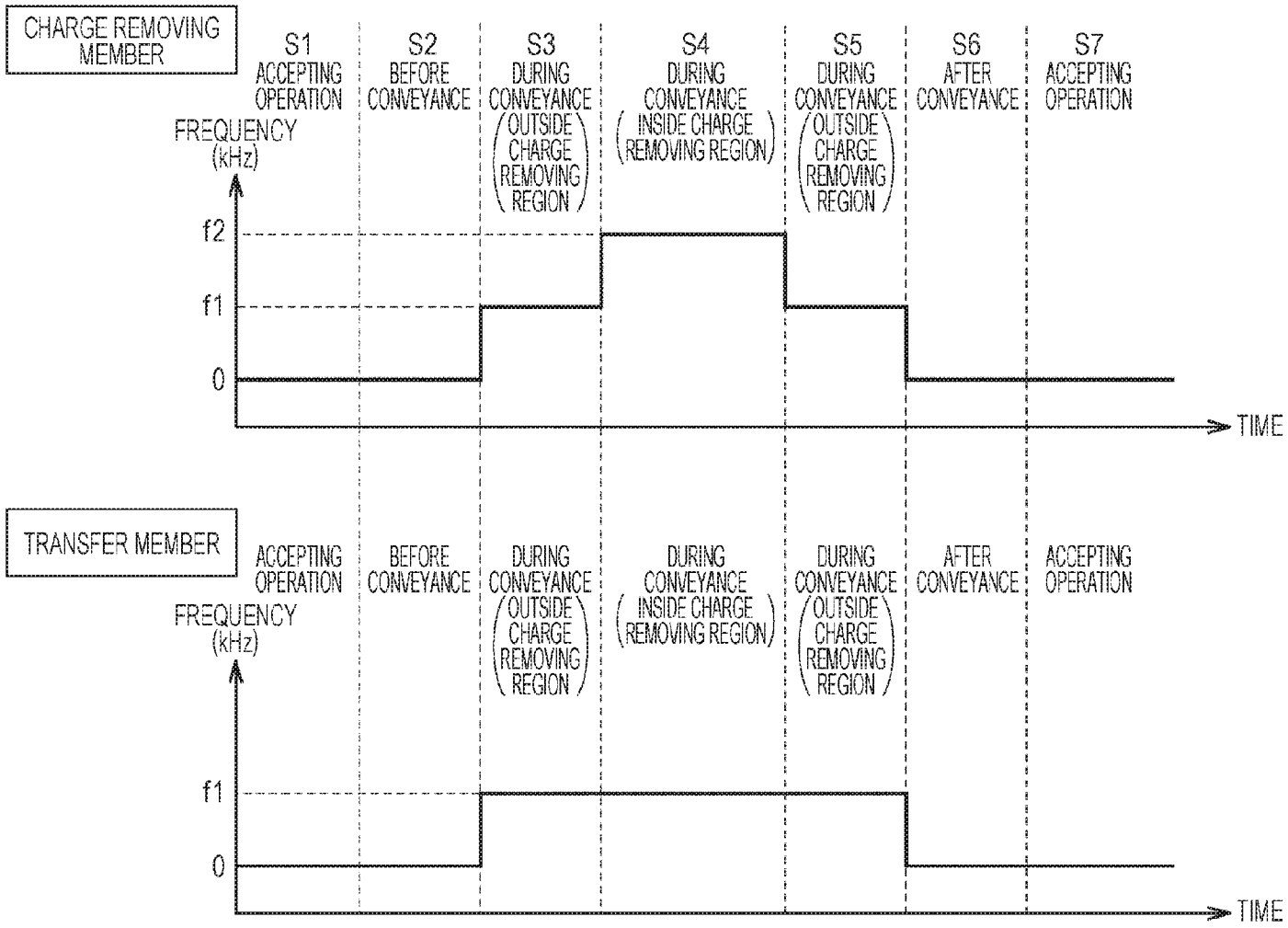
FIG. 2 is a diagram representing a timing for switching the frequency of a transfer voltage and the frequency of a charge removing voltage.

A method of controlling the transfer voltage applied to the secondary transfer member 33 and the charge removing voltage applied to the charge removing member 41 will be described with reference to FIGS. 2 to 4. FIG. 2 is a diagram representing a timing for switching the frequency of the transfer voltage and the frequency of the charge removing voltage.

The image forming apparatus 100 increases the frequency of the charge removing voltage to be higher than the frequency of the transfer voltage once the paper S is reached at a charge removing region C1 indicating the vicinity of the charge removing member 41. This results in an increase in a potential difference between the paper S and the charge removing member 41 to cause electrical discharge between the paper S and the charge removing member 41. The electrical charge can thus be removed from the paper S by increasing the frequency of the charge removing voltage to be higher than the frequency of the transfer voltage, without depending on a phase of each of the charge removing voltage and the transfer voltage. Therefore, the image forming apparatus 100 can effectively remove the electrical charge from the paper S even when the phase of the charge removing voltage and/or the transfer voltage is changed due to a failure to convey the paper S or the like. As a result, there can be prevented the failure to convey the paper S accompanying the unevenness in the potential, generation of noise accompanying the failure to convey the paper, and degradation in image quality caused by the unevenness in the potential.

As more specific voltage control processing, the image forming apparatus 100 executes voltage control processing in steps S1 to S7 as indicated in FIG. 2 according to the position of the paper S. The processing executed in each of steps S1 to S7 will now be described in order.

As indicated by step S1, the image forming apparatus 100 does not apply the transfer voltage to the secondary transfer member 33 prior to accepting a print operation from a user. The image forming apparatus 100 does not apply the charge removing voltage to the charge removing member 41, either.

It is assumed in step S2 that the image forming apparatus 100 accepts the print operation from the user. Accordingly, the image forming apparatus 100 starts preprocessing to perform printing on the paper S. As an example of the preprocessing, the image forming apparatus 100 stabilizes the potential of the surface of the photoreceptor 10, stabilizes high voltage output from each configuration, or adjusts the amount of the toner adhering to the photoreceptor 10. In the preprocessing, the image forming apparatus 100 sets the frequency of each of the transfer voltage and the charge removing voltage to zero and outputs only the DC component of each of the transfer voltage and the charge removing voltage.

The paper S starts to be conveyed in step S3. The paper S is conveyed to the secondary transfer member 33. FIG. 3 is a set of diagrams illustrating a potential 71 of the paper S, a potential 72 of the charge removing member 41, and a potential difference 73 between the paper S and the charge removing member 41 when the paper S is not reached at the charge removing region C1 indicating the vicinity of the charge removing member 41. The potential 71 of the paper S corresponds to the potential of the secondary transfer member 33.

Figure 3:
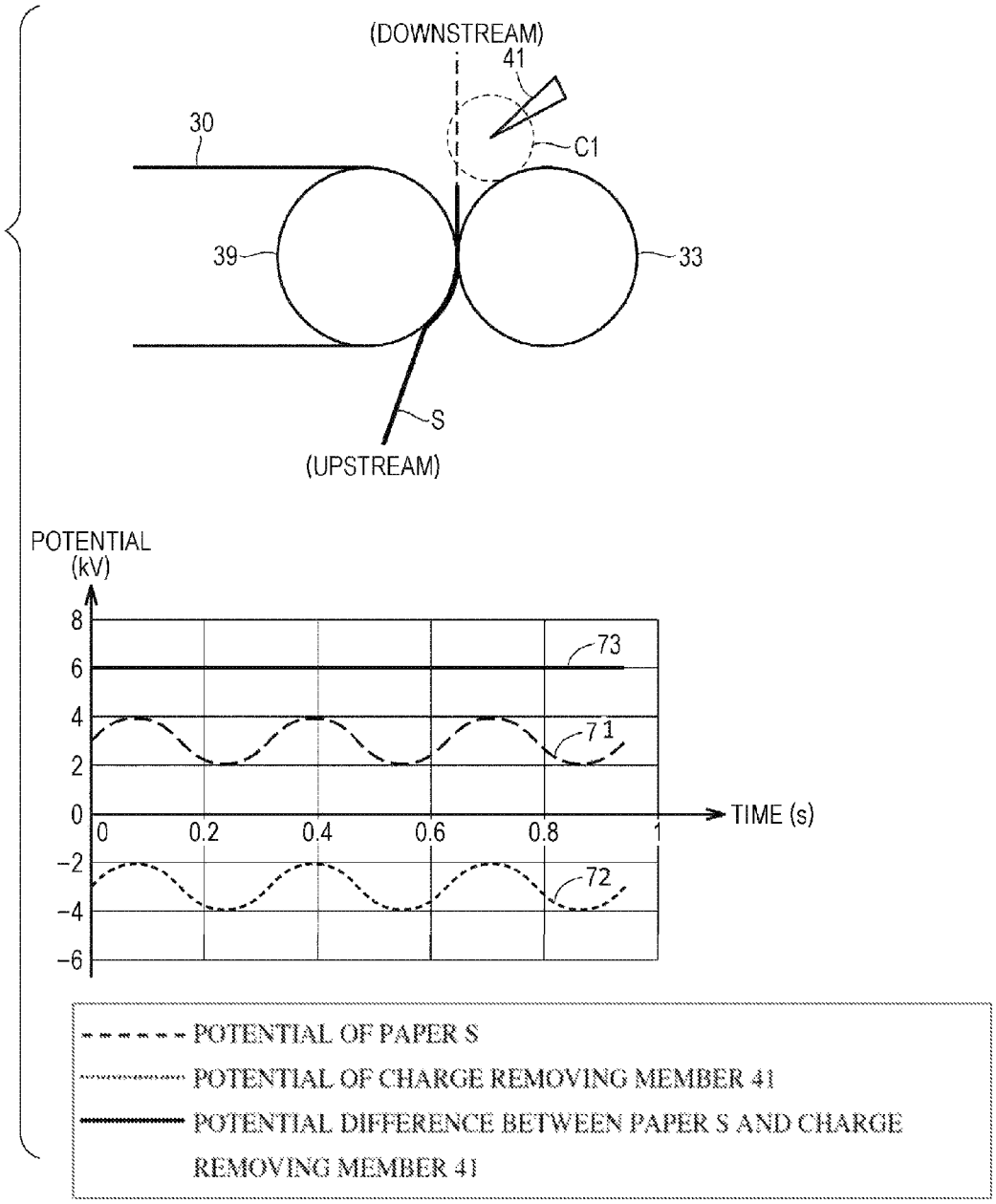
FIG. 3 is a set of diagrams illustrating a potential of paper, a potential of a charge removing member, and a potential difference between the paper and the charge removing member when the paper is not reached at a charge removing region indicating the vicinity of the charge removing member.

As illustrated in FIGS. 2 and 3, when the paper S is not reached at the charge removing region C1, the image forming apparatus 100 sets the frequency of each of the transfer voltage and the charge removing voltage to "f1" as well as sets the transfer voltage and the charge removing voltage to be in phase with each other. The transfer voltage and the charge removing voltage are set to be in phase with each other to allow the potential difference 73 between the paper S and the charge removing member 41 to be fixed and small compared to when the transfer voltage and the charge removing voltage are out of phase with each other. As a result, there can be prevented the possible electrical discharge between the secondary transfer member 33 and the charge removing member 41.

The DC component of the transfer voltage applied in step S3 equals the voltage of +3 kV, for example. The amplitude of the AC component of the transfer voltage equals ±1.0 kV, for example. The frequency of the transfer voltage equals 0.2 kHz, for example. The waveform of the transfer voltage is a sine wave, for example. The DC component of the charge removing voltage equals the voltage of −3 kV, for example. The amplitude of the AC component of the charge removing voltage equals ±1.0 kV, for example. The frequency of the charge removing voltage equals 0.2 kHz, for example. The waveform of the charge removing voltage is a sine wave, for example.

It is assumed in step S4 that the paper S is reached at the charge removing region C1. At this time, the unevenness in the potential is generated on a backside of the paper S due to the application of the transfer voltage in step S3. The backside refers to a surface opposite to the surface onto which the toner image is transferred. FIG. 4 is a set of diagrams illustrating the potential 71 of the paper S, the potential 72 of the charge removing member 41, and the potential difference 73 between the paper S and the charge removing member 41 when the paper S is reached at the charge removing region C1.

Figure 4:
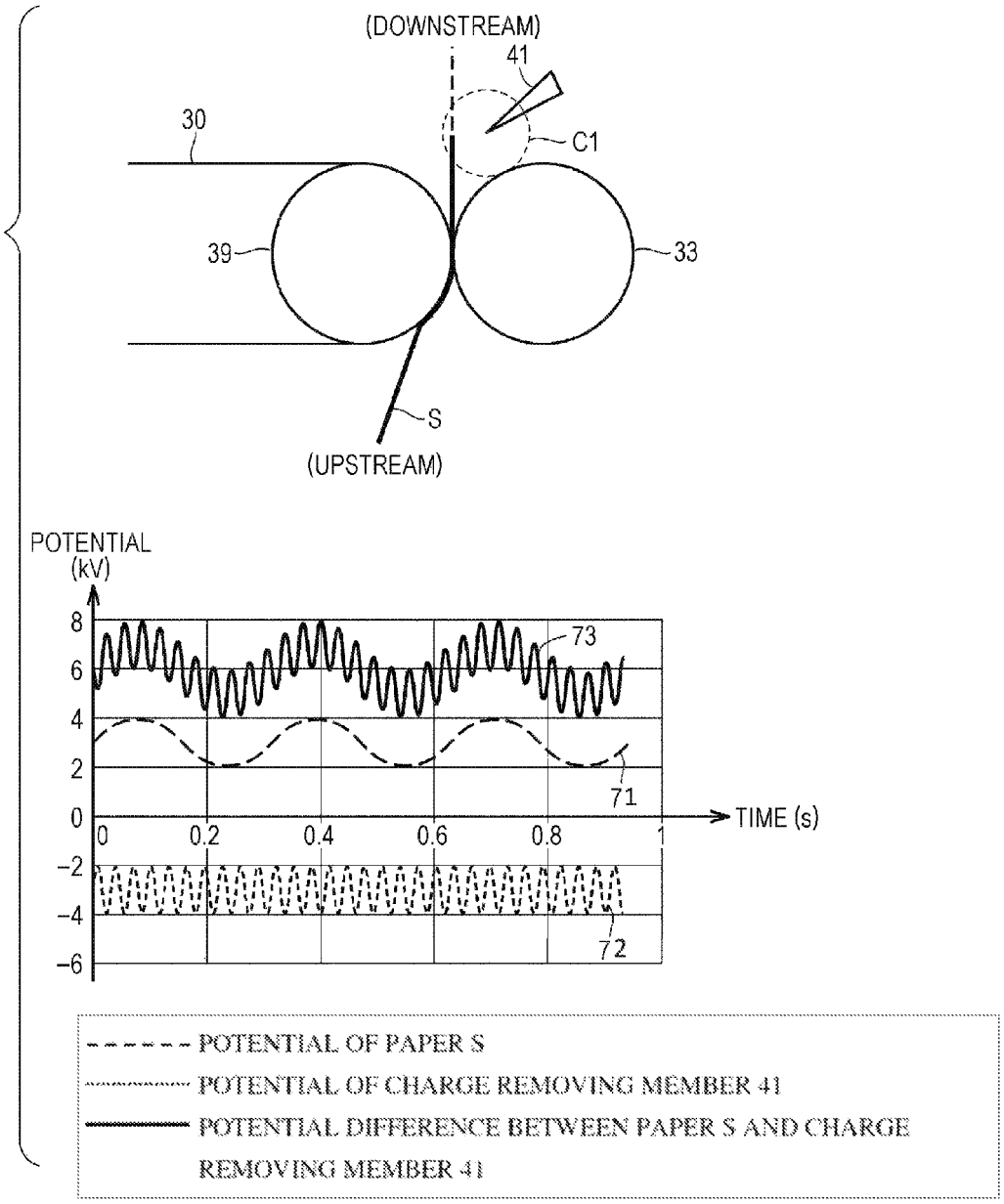
FIG. 4 is a set of diagrams illustrating the potential of the paper, the potential of the charge removing member, and the potential difference between the paper and the charge removing member when the paper is reached at the charge removing region.

As illustrated in FIGS. 2 and 4, the image forming apparatus 100 changes the frequency of the charge removing voltage when the paper S is reached at the charge removing region C1. The image forming apparatus 100 for example increases the frequency of the charge removing voltage from "f1" to "f2" when the paper S is reached at the charge removing region C1. The frequency of the transfer voltage is maintained at "f1".

The image forming apparatus 100 thus sets the frequency of the charge removing voltage higher than the frequency of the transfer voltage once the distance between the paper S being conveyed and the charge removing member 41 becomes shorter than a predetermined distance. Accordingly, the voltage difference between the charge removing voltage and the transfer voltage is increased at a timing when the paper S approaches the charge removing member 41. As a result, there occurs the electrical discharge between the paper S and the charge removing member 41 to be able to effectively remove the electrical charge from the paper S.

It is preferred that the frequency of the charge removing voltage be set to an integral multiple (such as triple or higher) of the frequency of the transfer voltage. The frequency of the charge removing voltage is preferably set to 100 Hz to 10 kHz, for example. This can prevent an increase in temperature of the board accompanying high frequency. Moreover, the potential difference 73 now follows the potential 72 of the backside of the paper S, so that the image forming apparatus 100 can more effectively and evenly remove the electrical charge from the paper S.

The DC component of the transfer voltage applied in step S4 equals the voltage of +3 kV, for example. The amplitude of the AC component of the transfer voltage equals ±1.0 kV, for example. The frequency of the transfer voltage equals 0.2 kHz, for example. The waveform of the transfer voltage is a sine wave, for example. The DC component of the charge removing voltage equals the voltage of −3 kV, for example. The amplitude of the AC component of the charge removing voltage equals ±1.0 kV, for example. The frequency of the charge removing voltage equals 1.0 kHz, for example. That is, the frequency of the charge removing voltage is set to be five times the frequency of the transfer voltage. The waveform of the charge removing voltage is a sine wave, for example.

It is assumed in step S5 that the paper S passes through the charge removing region C1. At this time, the image forming apparatus 100 restores the frequency of the charge removing voltage and sets the charge removing voltage and the transfer voltage to be in phase with each other. More specifically, the image forming apparatus 100 decreases the frequency of the charge removing voltage from "f2" to "f1" while maintaining the frequency of the transfer voltage at "f1".

It is assumed in step S6 that print processing is completed. The image forming apparatus 100 at this time stops applying the transfer voltage and the charge removing voltage as postprocessing.

In step S7, the image forming apparatus 100 shifts back to the state to accept the print operation from the user.

[Comparison Result]

Figure 5:
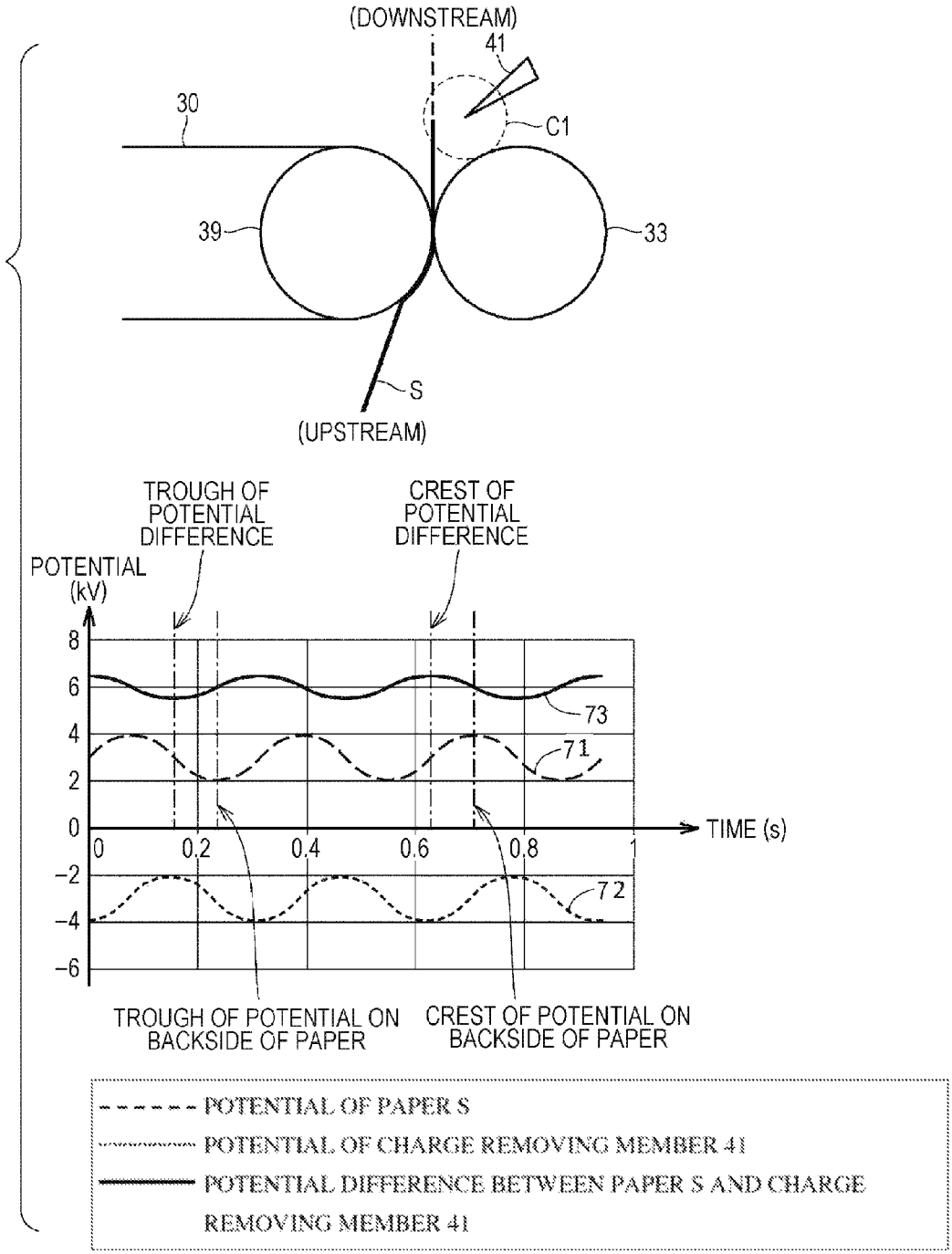
FIG. 5 is a set of diagrams illustrating voltage control according to a comparative example.

There will be described an advantage of setting the frequency of the charge removing voltage higher than the frequency of the transfer voltage when the paper S is reached at the charge removing region C1, with reference to FIG. 5 and back to FIG. 4. FIG. 5 is a set of diagrams illustrating voltage control according to a comparative example.

When the paper S is reached at the charge removing region C1, the image forming apparatus 100 according to the comparative example leaves the frequency of the charge removing voltage equal to the frequency of the transfer voltage without setting the frequency of the charge removing voltage higher than the frequency of the transfer voltage. As a result, the potential 71 of the paper S generated by the application of the transfer voltage, the potential 72 of the charge removing member 41, and the potential difference 73 between the paper S and the charge removing member 41 have a relationship as illustrated in FIG. 5. In the comparative example, the potential difference 73 is not increased since a crest of the potential 71 is not aligned with a trough of the potential 72, or a trough of the potential 71 is not aligned with a crest of the potential 72.

On the other hand, as illustrated in FIG. 4, the image forming apparatus 100 according to the first embodiment sets the frequency of the charge removing voltage higher than the frequency of the transfer voltage when the paper S is reached at the charge removing region C1. This increases the potential difference 73 since the amount of misalignment between the crest of the potential 71 and the trough of the potential 72 is decreased, or the amount of misalignment between the trough of the potential 71 and the crest of the potential 72 is decreased. The image forming apparatus 100 according to the first embodiment can thus increase the potential difference 73 between the paper S and the charge removing member 41 without depending on the phase of each of the transfer voltage and the charge removing voltage. As a result, there occurs the electrical discharge between the paper S and the charge removing member 41 to be able to remove the electrical charge from the paper S. Moreover, the potential difference 73 follows the potential 72 of the paper S, so that the image forming apparatus 100 can effectively and evenly remove the electrical charge from the paper S.

[Circuit Structure]

Figure 6:
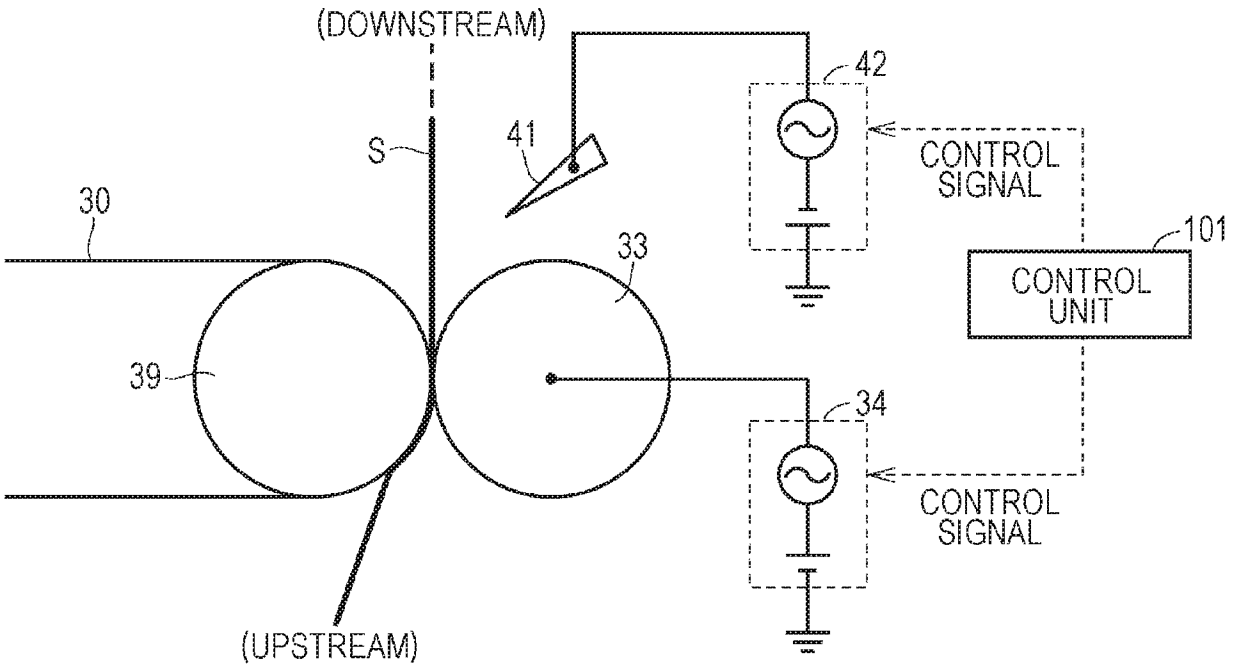
FIG. 6 is a diagram illustrating an example of the configuration of a circuit controlling the transfer voltage and the charge removing voltage.

The configuration of a circuit controlling the transfer voltage and the charge removing voltage will be described with reference to FIG. 6. FIG. 6 is a diagram illustrating an example of the configuration of the circuit controlling the transfer voltage and the charge removing voltage.

As illustrated in FIG. 6, the secondary transfer member 33 is connected in series to a power supply 34. The power supply 34 is formed of a constant voltage source or constant current source and an AC voltage source or AC current source. Accordingly, the transfer voltage on which the DC component and the AC component are superimposed is applied to the secondary transfer member 33. The control unit 101 transmits a control signal to the power supply 34 to control the frequency and phase of the transfer voltage.

The charge removing member 41 is connected in series to a power supply 42. The power supply 42 is formed of a constant voltage source or constant current source and an AC voltage source or AC current source. Accordingly, the charge removing voltage on which the DC component and the AC component are superimposed is applied to the charge removing member 41. The DC component of the charge removing voltage is opposite in polarity to the DC component of the transfer voltage. The transfer voltage applied to the paper S is cancelled out by the charge removing voltage so that the electrical charge is removed from the paper S. The control unit 101 transmits a control signal to the power supply 34 to control the frequency and phase of the charge removing voltage.

[Charge Removing Region]

Figure 7:
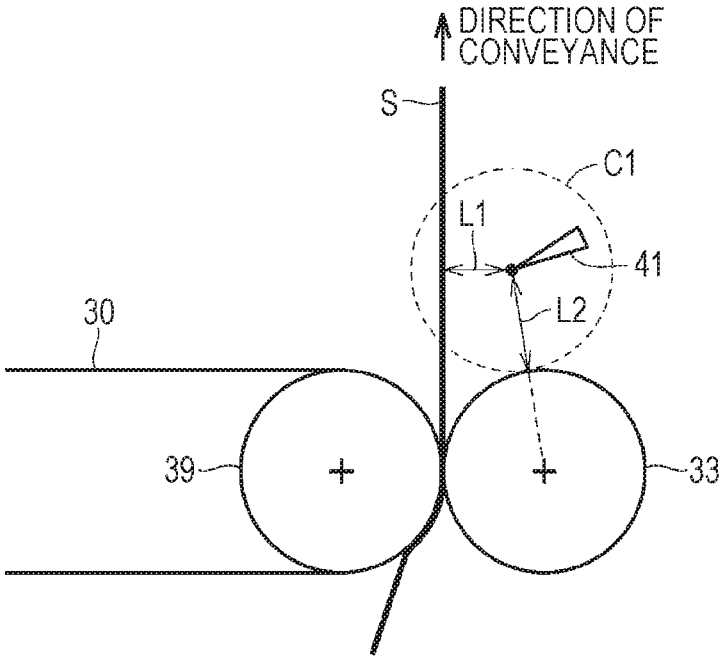
FIG. 7 is a diagram illustrating an example of the charge removing region.
Figure 8:
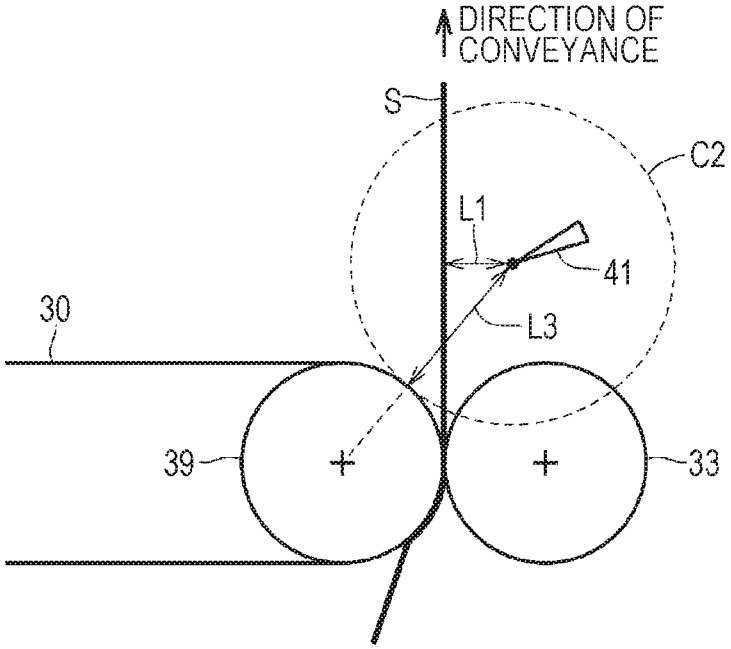
FIG. 8 is a diagram illustrating another example of the charge removing region.
Figures 9, 10:
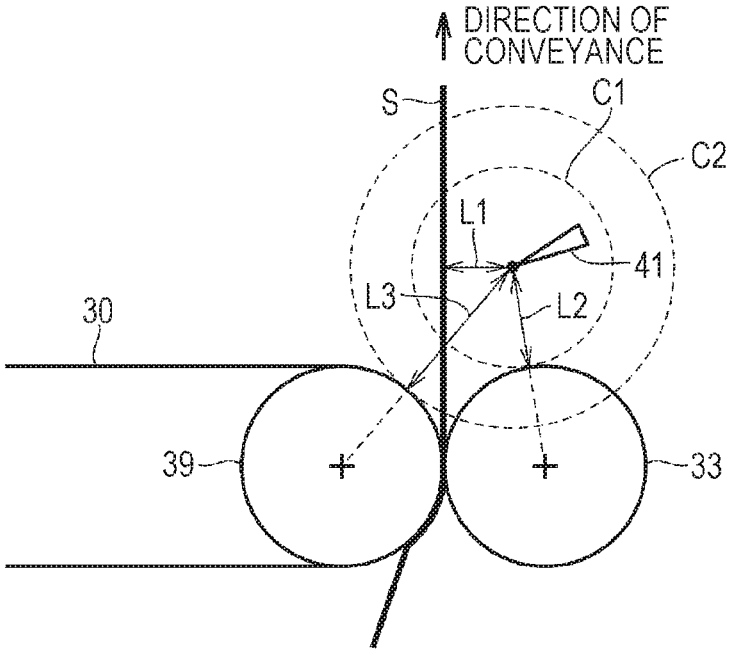
FIG. 9 is a diagram illustrating yet another example of the charge removing region.
FIG. 10 is a table illustrating the description of paper information that is referenced at the time of determining the transfer voltage and the charge removing voltage.

The aforementioned charge removing region C1 will be described with reference to FIGS. 7 to 9. FIG. 7 is a diagram illustrating an example of the charge removing region. FIG. 8 is a diagram illustrating another example of the charge removing region. FIG. 9 is a diagram illustrating yet another example of the charge removing region.

As illustrated in FIG. 7, the secondary transfer member 33 and the charge removing member 41 are provided along a path through which the paper S is conveyed. More specifically, the charge removing member 41 is provided further in the direction in which the paper S is conveyed relative to the secondary transfer member 33 (namely, downstream of the secondary transfer member).

According to an aspect, the charge removing region C1 is determined in advance according to a distance L2 between the secondary transfer member 33 and the charge removing member 41. The charge removing region C1 for example represents a region within a range with the charge removing member 41 at the center thereof and the distance L2 as the radius. That is, the radius of the charge removing region C1 is shorter than the distance L2 between the secondary transfer member 33 and the charge removing member 41.

The image forming apparatus 100 sets the frequency of the charge removing voltage to be higher than the frequency of the transfer voltage once the paper S is reached at the charge removing region C1. That is, the image forming apparatus 100 sets the frequency of the charge removing voltage higher than the frequency of the transfer voltage once a distance L1 between the paper S being conveyed and the charge removing member 41 is shorter than the distance L2 between the charge removing member 41 and the secondary transfer member 33. The distance L1 for example represents the shortest distance between the paper S being conveyed and the charge removing member 41.

The frequency of the charge removing voltage is set higher than the frequency of the transfer voltage once the distance L1 is shorter than the distance L2, whereby the electrical discharge is more likely to occur between the charge removing member 41 and the paper S than between the charge removing member 41 and the secondary transfer member 33. The electrical discharge between the charge removing member 41 and the secondary transfer member 33 can thus be prevented, while at the same time the electrical charge is effectively removed from the paper S.

According to another aspect, as illustrated in FIG. 8, a charge removing region C2 is determined in advance according to a distance L3 between the charge removing member 41 and the intermediate transfer belt 30 serving as an image carrier. The intermediate transfer belt 30 and the charge removing member 41 are provided while interposing therebetween the path through which the paper S is conveyed. The distance L3 corresponds to a distance between a tip of the charge removing member 41 and a surface of the intermediate transfer belt 30 or an outer peripheral surface of the driving roller 39, for example. The charge removing region C2 represents a region within a range with the charge removing member 41 at the center thereof and the distance L3 as the radius. That is, the radius of the charge removing region C2 is shorter than the distance L3 between the charge removing member 41 and the intermediate transfer belt 30.

The image forming apparatus 100 sets the frequency of the charge removing voltage to be higher than the frequency of the transfer voltage once the paper S is reached at the charge removing region C2. That is, the image forming apparatus 100 sets the frequency of the charge removing voltage higher than the frequency of the transfer voltage once the distance L1 between the paper S being conveyed and the charge removing member 41 is shorter than the distance L3 between the intermediate transfer belt 30 and the charge removing member 41.

The frequency of the charge removing voltage is set higher than the frequency of the transfer voltage once the distance L1 is shorter than the distance L3, whereby the electrical discharge is more likely to occur between the charge removing member 41 and the paper S than between the charge removing member 41 and the intermediate transfer belt 30. The electrical discharge between the charge removing member 41 and the intermediate transfer belt 30 can thus be prevented, while at the same time the electrical charge is effectively removed from the paper S.

According to yet another aspect, as illustrated in FIG. 9, the charge removing region C1 in FIG. 7 and the charge removing region C2 in FIG. 8 may be combined. The smaller one of the charge removing region C1 and the charge removing region C2 is adopted as the charge removing region, for example. Alternatively, the larger one of the charge removing region C1 and the charge removing region C2 may be adopted as the charge removing region. Yet alternatively, an overlapping region between the charge removing region C1 and the charge removing region C2 may be adopted as the charge removing region.

[Method of Detecting that Paper S is Reached at Charge Removing Region]

There will now be described a method of detecting that the paper S is reached at the charge removing region C1 (refer to FIG. 7).

The image forming apparatus 100 includes a detection unit that detects the position of the paper S on the conveyance path therefor. The detection unit is the timing roller 40 (refer to FIG. 1), for example. The timing roller 40 is provided upstream of the charge removing member 41 along the path through which the paper S is conveyed. The timing roller 40 sends the paper S at a predetermined timing. The control unit 101 calculates time Ta required for the paper S to reach the charge removing region C1 on the basis of a distance La between the timing roller 40 and the charge removing region C1 and speed V of conveying the paper S, according to expression (1) below.

$$Ta(\mathrm{s})=V(\mathrm{mm/s})/La(\mathrm{mm}) \quad (1)$$

The control unit 101 determines that the paper S is reached at the charge removing region C1 after the lapse of the time Ta since the timing at which the paper S is sent by the timing roller 40, and sets the frequency of the charge removing voltage higher than the frequency of the transfer voltage. That is, the timing to change the frequency of the transfer voltage includes a timing corresponding to the lapse of the predetermined time Ta since the timing roller 40 detects the paper S.

As another detection unit detecting the paper S, the control unit 101 detects the paper S passing through a nip portion between the intermediate transfer belt 30 and the secondary transfer member 33. A voltage value or current value of the secondary transfer member 33 changes when the paper S passes through the nip portion. Paying attention to this respect, the control unit 101 detects that the paper S is reached at the nip portion between the intermediate transfer belt 30 and the secondary transfer member 33 when the voltage value or current value of the secondary transfer member 33 changes by a predetermined value or more. The control unit 101 calculates time Tb required for the paper S to reach the charge removing region C1 on the basis of a distance Lb between the nip portion and the charge removing region C1 and the speed V of conveying the paper S, according to expression (2) below.

$$Tb(\mathrm{s})=V(\mathrm{mm/s})/Lb(\mathrm{mm}) \quad (2)$$

The control unit 101 determines that the paper S is reached at the charge removing region C1 after the lapse of the time Tb since the timing at which the paper S reaches the nip portion between the intermediate transfer belt 30 and the secondary transfer member 33, and sets the frequency of the charge removing voltage higher than the frequency of the transfer voltage. That is, the timing to change the frequency of the transfer voltage includes a timing corresponding to the lapse of the predetermined time Tb since the paper S is detected in the nip portion between the intermediate transfer belt 30 and the secondary transfer member 33.

[Paper Information 124]

A method of determining the transfer voltage and the charge removing voltage will be described with reference to FIG. 10. FIG. 10 is a table illustrating the description of paper information 124 that is referenced at the time of determining the transfer voltage and the charge removing voltage.

An optimum transfer voltage varies depending on the type of paper. Transfer efficiency for paper having a rough surface such as embossed paper is improved when the DC component and the AC component of the transfer voltage are increased. On the other hand, transfer efficiency for thin paper is not reduced as much even when the DC component and the AC component of the transfer voltage are small.

Likewise, an optimum charge removing voltage varies depending on the type of paper. As for paper having low paper resistance such as the thin paper, for example, it is preferred for the DC component and the AC component of the charge removing voltage to be small in order for the electrical charge to not be removed excessively from the paper. As for paper having high paper resistance, on the other hand, it is preferred for the DC component and the AC component of the charge removing voltage to be large in order to increase efficiency of removing the electrical charge from the paper.

As illustrated in FIG. 10, paper information 124 specifies a voltage control value for each of the transfer voltage and the charge removing voltage according to a property of paper. More specifically, the paper information 124 specifies the voltage control value of the transfer voltage for each property of the paper. The image forming apparatus 100 refers to the paper information 124 to acquire a voltage control value corresponding to the property of paper subjected to printing, and controls the transfer voltage applied to the secondary transfer member 33 according to the voltage control value. As a result, the image forming apparatus 100 can apply the transfer voltage appropriate for the property of the paper and increase the efficiency of transferring the toner image.

Moreover, the paper information 124 specifies the voltage control value of the charge removing voltage for each property of the paper. The image forming apparatus 100 refers to the paper information 124 to acquire a voltage control value corresponding to the property of paper subjected to printing, and controls the charge removing voltage applied to the charge removing member 41 according to the voltage control value. As a result, the image forming apparatus 100 can effectively remove the electrical charge from the paper in accordance with the property of the paper.

The property of the paper specified in the paper information 124 includes thickness of the paper, for example. The property of the paper is acquired from print setting information, for example. The voltage control value of the secondary transfer member 33 specified in the paper information 124 includes magnitude of the DC component of the transfer voltage and the frequency of the AC component of the transfer voltage, for example. The voltage control value of the charge removing member 41 specified in the paper information 124 includes magnitude of the DC component of the charge removing voltage, the frequency of the AC component of the charge removing voltage and the like.

It is preferred that the paper information 124 further include an ambient condition around the image forming apparatus 100 for each voltage control value. The ambient condition includes temperature information and humidity information, for example. The image forming apparatus 100 detects temperature and humidity inside the apparatus and acquires the voltage control value associated with the temperature and the humidity from the paper information 124. The image forming apparatus 100 controls the transfer voltage and the charge removing voltage according to the voltage control value acquired. The image forming apparatus 100 can therefore apply, to the paper, the transfer voltage and the charge removing voltage appropriate for the ambience.

[Control Structure]

Figure 11:
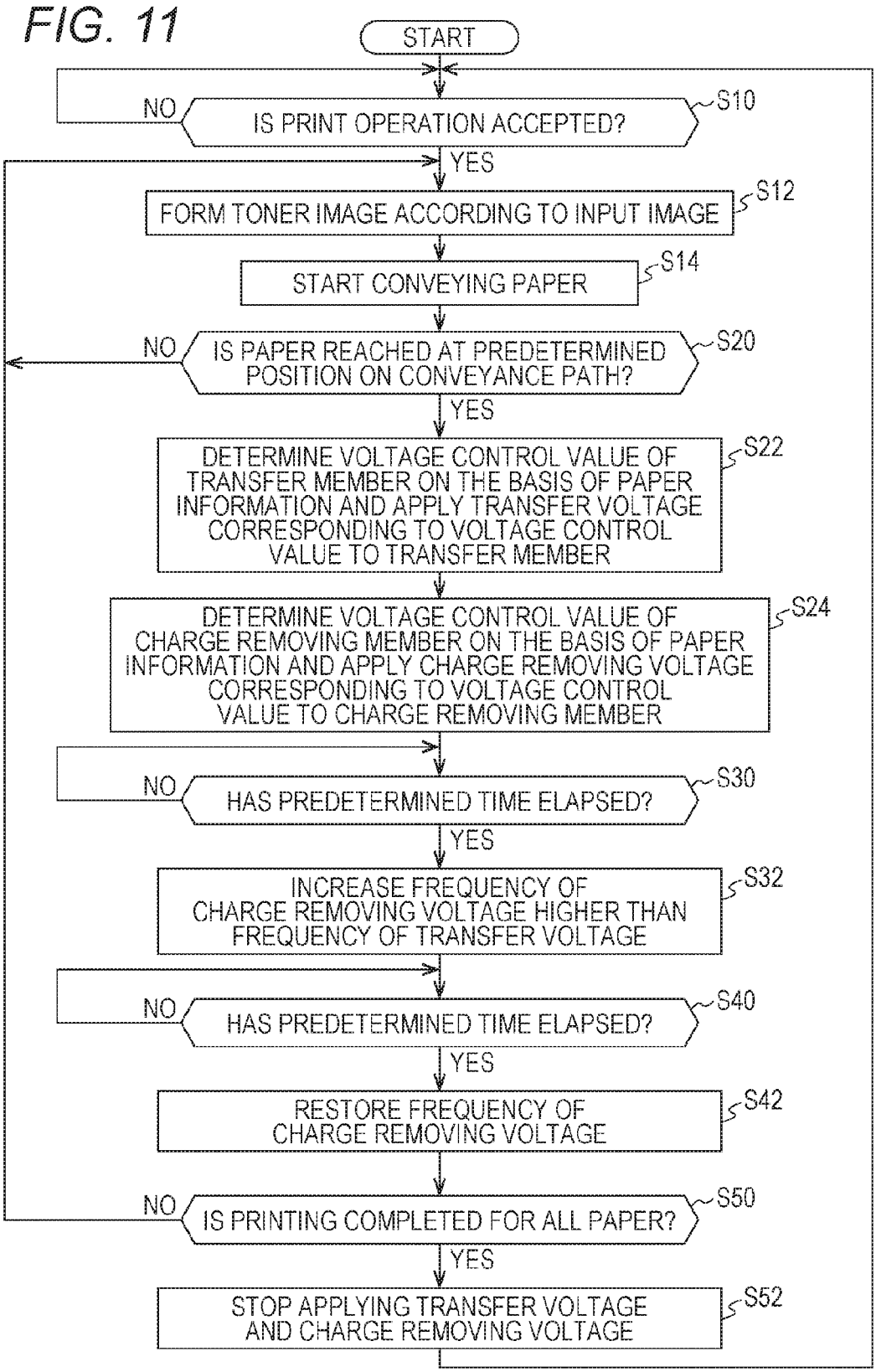
FIG. 11 is a flowchart illustrating a part of processing executed by the image forming apparatus according to the first embodiment.

A control structure of the image forming apparatus 100 will be described with reference to FIG. 11. FIG. 11 is a flowchart illustrating a part of processing executed by the image forming apparatus 100. The processing illustrated in FIG. 11 is implemented when the control unit 101 of the image forming apparatus 100 executes a program. In another aspect, a part or all of the processing may be executed by a circuit element or another hardware.

In step S10, the control unit 101 determines whether or not a print operation is accepted. The control unit 101 switches control to step S12 when determining that the print operation is accepted (YES in step S10). Otherwise (NO in step S10), the control unit 101 re-executes the processing in step S10.

In step S12, the control unit 101 causes the image forming apparatus 100 to execute processing that forms a toner image according to an input image. More specifically, the control unit 101 transmits a control signal to the exposure unit 12 (refer to FIG. 1). The exposure unit 12 then exposes the surface of the photoreceptor 10 (refer to FIG. 1) according to the input image. As a result, an electrostatic latent image corresponding to the input image is formed on the photoreceptor 10. The control unit 101 thereafter performs control to apply a developing bias to the developing roller 14 (refer to FIG. 1). This allows the toner to be transferred from the developing roller 14 to the photoreceptor 10, on the surface of which the toner image corresponding to the electrostatic latent image is formed.

In step S14, the control unit 101 causes the image forming apparatus 100 to execute processing that conveys paper. The control unit 101 at this time controls a timing to convey the paper in accordance with the position of the toner image on the intermediate transfer belt 30 (refer to FIG. 1).

In step S20, the control unit 101 functions as a paper position detection unit to determine whether or not the paper is reached at a predetermined position on the conveyance path. The predetermined position is a position on the path through which the paper is conveyed upstream of the charge removing region C1 (refer to FIG. 3). The method of detecting the position of the paper is described above and thus will not be redescribed. The control unit 101 switches control to step S22 when determining that the paper is reached at the predetermined position on the conveyance path (YES in step S20). Otherwise (NO in step S20), the control unit 101 re-executes the processing in step S20.

In step S22, the control unit 101 applies, to the paper being conveyed, the transfer voltage which is opposite in polarity to the toner image and on which the DC component and the AC component are superimposed, and causes the image forming apparatus 100 to execute processing that transfers the toner image to the paper. More specifically, the control unit 101 acquires the property of the paper subjected to printing (such as the thickness of the paper) from the print setting information. The control unit 101 refers to the paper information 124 (refer to FIG. 10) and acquires the voltage control value of the transfer voltage associated with the acquired property of the paper. The control unit 101 applies the transfer voltage corresponding to the acquired voltage control value to the secondary transfer member 33.

In step S24, after application of the transfer voltage to the paper, the control unit 101 causes the image forming apparatus 100 to execute processing in which the charge removing member 41 (refer to FIG. 1) provided on the paper conveyance path applies, to the paper, the charge removing voltage which is opposite in polarity to the transfer voltage and on which the DC component and the AC component are superimposed. More specifically, the control unit 101 refers to the paper information 124 and acquires the voltage control value of the charge removing voltage associated with the property of the paper subjected to printing. The control unit 101 applies the charge removing voltage corresponding to the acquired voltage control value to the charge removing member 41.

In step S30, the control unit 101 determines whether or not predetermined time elapses since the paper is detected in step S20. The control unit 101 determines that the paper is reached at the charge removing region C1 after the lapse of the predetermined time. The control unit 101 switches control to step S32 when determining that the predetermined time elapses since the paper is detected in step S20 (YES in step S30). Otherwise (NO in step S30), the control unit 101 re-executes the processing in step S30.

In step S32, the control unit 101 increases the frequency of the charge removing voltage applied to the charge removing member 41 to be higher than the frequency of the transfer voltage applied to the secondary transfer member 33. Accordingly, through steps S30 and S32, the frequency of the charge removing voltage is set higher than the frequency of the transfer voltage at the timing when the paper approaches the charge removing member 41. That is, the control unit 101 causes the image forming apparatus 100 to execute processing that changes the frequency of the charge removing voltage once the distance between the paper being conveyed and the charge removing member 41 becomes shorter than a predetermined distance.

In step S40, the control unit 101 determines whether or not predetermined time elapses since the paper S is reached at the charge removing region C1. The control unit 101 determines that the paper passes through the charge removing region C1 after the lapse of the predetermined time. The control unit 101 switches control to step S42 when determining that the predetermined time elapses since the paper S is reached at the charge removing region C1 (YES in step S40). Otherwise (NO in step S40), the control unit 101 re-executes the processing in step S40.

In step S42, the control unit 101 restores the frequency of the charge removing voltage applied to the charge removing member 41. The control unit 101 for example sets the frequency of the charge removing voltage equal to the frequency of the transfer voltage. The control unit 101 preferably sets the charge removing voltage and the transfer voltage to be in phase with each other.

In step S50, the control unit 101 determines whether or not printing is completed on all the paper for which a print instruction is received. The control unit 101 switches control to step S52 when determining that printing is completed on all the paper (YES in step S50). Otherwise (NO in step S50), the control unit 101 returns control to step S20.

In step S52, the control unit 101 stops applying the transfer voltage and the charge removing voltage.

[Hardware Configuration of Image Forming Apparatus 100]

Figure 12:
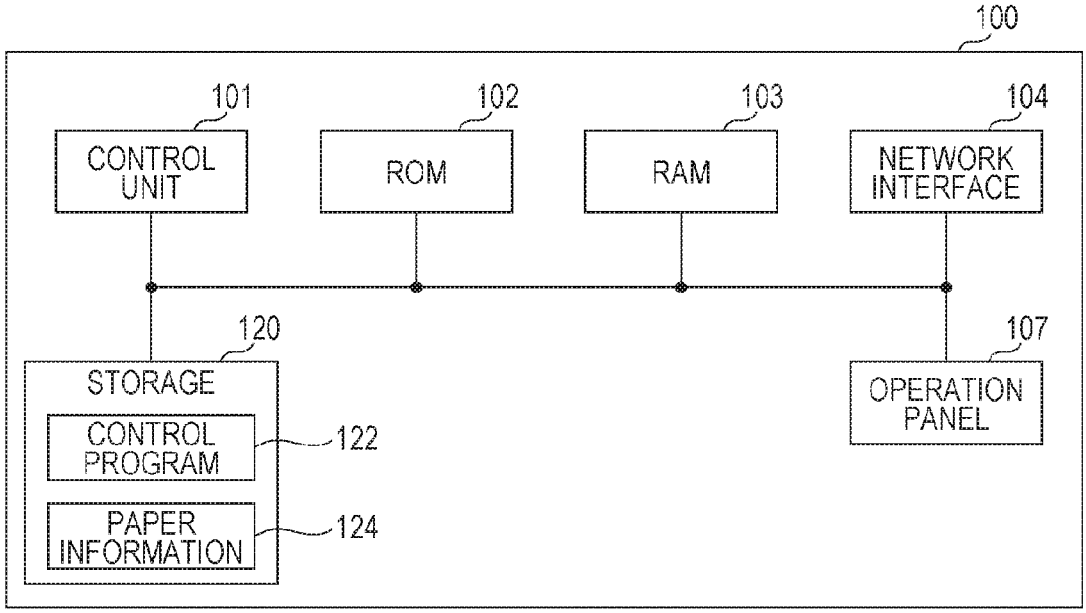
FIG. 12 is a block diagram illustrating an example of a hardware configuration of the image forming apparatus according to the first embodiment.

An example of the hardware configuration of the image forming apparatus 100 will be described with reference to FIG. 12. FIG. 12 is a block diagram illustrating an example of the hardware configuration of the image forming apparatus 100.

As illustrated in FIG. 12, the image forming apparatus 100 includes the control unit 101, a read only memory (ROM) 102, a random access memory (RAM) 103, a network interface 104, an operation panel 107, and a storage 120.

The control unit 101 is formed of at least one integrated circuit, for example. The integrated circuit is for example formed of at least one central processing unit (CPU), at least one application specific integrated circuit (ASIC), at least one field programmable gate array (FPGA), or a combination of these.

The control unit 101 controls the operation of the image forming apparatus 100 by executing various programs such as a control program 122 according to the present embodiment. The control unit 101 reads the control program 122 from the storage 120 to the ROM 102 upon accepting an execution command for the control program 122. The RAM 103 functions as a working memory to temporarily store various data required for executing the control program 122.

An antenna (not shown) or the like is connected to the network interface 104. The image forming apparatus 100 exchanges data with an external communication device via the antenna. The external communication device includes a mobile communication terminal such as a smart phone and a server, for example. The image forming apparatus 100 may be configured to be able to download the control program 122 of the present embodiment from the server via the antenna.

The operation panel 107 is formed of a display and a touch panel. The display and the touch panel are placed on top of each other, where the operation panel 107 accepts a touch operation on the display. The operation panel 107 accepts the print operation and a scan operation to be performed by the image forming apparatus 100, for example.

The storage 120 is a storage medium such as a hard disk or an external storage, for example. The storage 120 stores the control program 122 according to the present embodiment, the paper information 124 (refer to FIG. 10) and the like. The paper information 124 need not necessarily be stored in the storage 120 but may be stored in a storage area (such as a cache) of the control unit 101, the ROM 102, the RAM 103, or an external device (such as the server).

The control program 122 may be provided not as a single program but may be provided while being incorporated into a part of an arbitrary program. In this case, the processing according to the present embodiment is implemented in cooperation with the arbitrary program. Such program not including some module does not depart from the gist of the control program 122 according to the present embodiment. Moreover, a part or all of the function provided by the control program 122 may be implemented by dedicated hardware. The image forming apparatus 100 may also be configured such that at least one server executes a part of processing in the control program 122 like a so-called cloud service.

Summary of First Embodiment

As described above, the image forming apparatus 100 according to the first embodiment sets the frequency of the charge removing voltage higher than the frequency of the transfer voltage when the paper is reached at the charge removing region indicating the vicinity of the charge removing member. The frequency of the charge removing voltage is set higher than the frequency of the transfer voltage at the timing when the paper approaches the charge removing member 41, whereby the voltage difference between the charge removing voltage and the transfer voltage is increased. As a result, there occurs the electrical discharge between the paper S and the charge removing member 41 to be able to effectively remove the electrical charge from the paper S.

Second Embodiment

Figure 13:
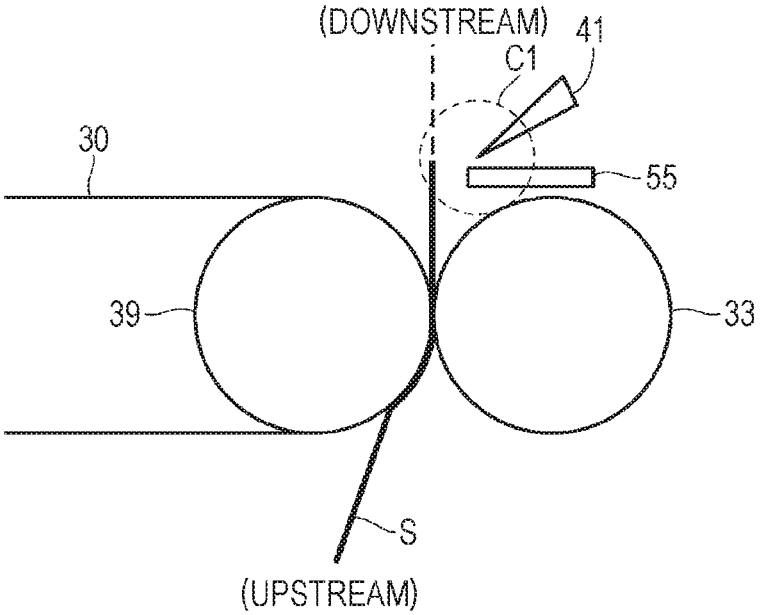
FIG. 13 is a diagram illustrating the structure around a charge removing member of an image forming apparatus according to a second embodiment.

An image forming apparatus 100 according to a second embodiment will be described with reference to FIG. 13. FIG. 13 is a diagram illustrating the structure around a charge removing member 41 of the image forming apparatus 100 according to the second embodiment.

In the second embodiment, an insulating member 55 is additionally provided between a secondary transfer member 33 and a charge removing member 41. Accordingly, electrical discharge does not occur between the charge removing member 41 and the secondary transfer member 33 even when a potential difference between the charge removing member 41 and the secondary transfer member 33 is increased where the charge removing member 41 is provided in the vicinity of the secondary transfer member 33.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include meanings equivalent to the scope of the claims and all modifications within the scope of the claims.

What is claimed is:

1. An image forming apparatus that transfers a toner image formed according to an input image to a medium being conveyed, the apparatus comprising:

an image carrier configured to carry the toner image;

a transfer member configured to apply, to the medium being conveyed, a first AC voltage which is opposite in polarity to the toner image and on which a DC component and an AC component are superimposed, and transfer the toner image to the medium;

a charge removing member configured to apply, to the medium being conveyed, a second AC voltage which is opposite in polarity to the first AC voltage and on which a DC component and an AC component are superimposed after the first AC voltage is applied to the medium; and a control unit configured to change a frequency of the second AC voltage when a distance between the medium being conveyed and the charge removing member becomes shorter than a predetermined distance, wherein the first AC voltage is entirely positive or entirely negative.

2. The image forming apparatus according to claim 1, wherein the transfer member and the charge removing member are provided along a path through which the medium is conveyed, and the predetermined distance is shorter than a distance between the charge removing member and the transfer member.

3. The image forming apparatus according to claim 1, wherein the image carrier and the charge removing member are provided while interposing the path through which the medium is conveyed between the image carrier and the charge removing member, and the predetermined distance is shorter than a distance between the charge removing member and the image carrier.

4. The image forming apparatus according to claim 1, further comprising a detection unit configured to detect the medium upstream of the charge removing member on the path through which the medium is conveyed, wherein a timing at which the control unit changes the frequency of the second AC voltage includes a timing corresponding to a lapse of predetermined time after the medium is detected by the detection unit.

5. The image forming apparatus according to claim 1, further comprising a detection unit configured to detect the medium passing through an area of contact between the image carrier and the transfer member, wherein the image carrier and the transfer member are in contact with each other while interposing the path through which the medium is conveyed between the image carrier and the transfer member, and a timing at which the control unit changes the frequency of the second AC voltage includes a timing corresponding to a lapse of predetermined time after the medium is detected by the detection unit.

6. The image forming apparatus according to claim 1, wherein the frequency of the second AC voltage is higher than a frequency of the first AC voltage.

7. The image forming apparatus according to claim 1, wherein the frequency of the second AC voltage is an integral multiple of a frequency of the first AC voltage.

8. The image forming apparatus according to claim 1, wherein the medium is paper, and the control unit acquires a control value corresponding to a property of the paper being conveyed on the basis of paper information specifying a control value of the first AC voltage for each paper property, and controls the first AC voltage according to the control value.

9. The image forming apparatus according to claim 1, wherein the medium is paper, and the control unit acquires a control value corresponding to a property of the paper being conveyed on the basis of paper information specifying a control value of the second AC voltage for each paper property, and controls the second AC voltage according to the control value.

10. The image forming apparatus according to claim 1, further comprising an insulating member that is provided between the transfer member and the charge removing member.

11. A method of controlling an image forming apparatus, the method comprising the steps of:

forming a toner image corresponding to an input image;

conveying a medium;

applying, to the medium being conveyed, a first AC voltage which is opposite in polarity to the toner image and on which a DC component and an AC component are superimposed, and transferring the toner image to the medium;

employing a charge removing member provided on a path through which the medium is conveyed to apply, to the medium, a second AC voltage which is opposite in polarity to the first AC voltage and on which a DC component and an AC component are superimposed after applying the first AC voltage to the medium; and changing a frequency of the second AC voltage when a distance between the medium being conveyed and the charge removing member becomes shorter than a predetermined distance, wherein the first AC voltage is entirely positive or entirely negative.

12. The method of controlling an image forming apparatus according to claim 11, wherein a transfer member and the charge removing member are provided along the path through which the medium is conveyed, and the predetermined distance is shorter than a distance between the charge removing member and the transfer member.

13. The method of controlling an image forming apparatus according to claim 11, wherein an image carrier and the charge removing member are provided while interposing the path through which the medium is conveyed between the image carrier and the charge removing member, and the predetermined distance is shorter than a distance between the charge removing member and the image carrier.

14. The method of controlling an image forming apparatus according to claim 11, wherein the image forming apparatus further comprises a detection unit configured to detect the medium upstream of the charge removing member on the path through which the medium is conveyed, and a timing at which a control unit changes the frequency of the second AC voltage includes a timing corresponding to a lapse of predetermined time after the medium is detected by the detection unit.

15. The method of controlling an image forming apparatus according to claim 11, wherein the image forming apparatus further comprises a detection unit configured to detect the medium passing through an area of contact between an image carrier and a transfer member, the image carrier and the transfer member are in contact with each other while interposing the path through which the medium is conveyed between the image carrier and the transfer member, and a timing at which a control unit changes the frequency of the second AC voltage includes a timing corresponding to a lapse of predetermined time after the medium is detected by the detection unit.

16. A non-transitory recording medium storing a computer readable program for controlling an image forming apparatus, the program causing the image forming apparatus to execute the steps of:

forming a toner image corresponding to an input image;

conveying a medium;

applying, to the medium being conveyed, a first AC voltage which is opposite in polarity to the toner image and on which a DC component and an AC component are superimposed, and transferring the toner image to the medium;

employing a charge removing member provided on a path through which the medium is conveyed to apply, to the medium, a second AC voltage which is opposite in polarity to the first AC voltage and on which a DC component and an AC component are superimposed after applying the first AC voltage to the medium; and changing a frequency of the second AC voltage when a distance between the medium being conveyed and the charge removing member becomes shorter than a predetermined distance, wherein the first AC voltage is entirely positive or entirely negative.

17. The non-transitory recording medium storing a computer readable program for controlling an image forming apparatus according to claim 16, wherein a transfer member and the charge removing member are provided along the path through which the medium is conveyed, and the predetermined distance is shorter than a distance between the charge removing member and the transfer member.

18. The non-transitory recording medium storing a computer readable program for controlling an image forming apparatus according to claim 16, wherein an image carrier and the charge removing member are provided while interposing the path through which the medium is conveyed between the image carrier and the charge removing member, and the predetermined distance is shorter than a distance between the charge removing member and the image carrier.

19. The non-transitory recording medium storing a computer readable program for controlling an image forming apparatus according to claim 16, wherein the image forming apparatus further comprises a detection unit configured to detect the medium upstream of the charge removing member on the path through which the medium is conveyed, and a timing at which a control unit changes the frequency of the second AC voltage includes a timing corresponding to a lapse of predetermined time after the medium is detected by the detection unit.

20. The non-transitory recording medium storing a computer readable program for controlling an image forming apparatus according to claim 16, wherein the image forming apparatus further comprises a detection unit configured to detect the medium passing through an area of contact between an image carrier and a transfer member, the image carrier and the transfer member are in contact with each other while interposing the path through which the medium is conveyed between the image carrier and the transfer member, and a timing at which a control unit changes the frequency of the second AC voltage includes a timing corresponding to a lapse of predetermined time after the medium is detected by the detection unit.

* * * * *